US006227108B1

(12) United States Patent
Kempen et al.

(10) Patent No.: US 6,227,108 B1
(45) Date of Patent: May 8, 2001

(54) MAGNET BAR

(75) Inventors: Henricus G. M. Kempen, Ledeacker; Patrick G. L .H. Lagarde, Eindhoven, both of (NL)

(73) Assignee: Stork Brabank B.V. (NL)

( * ) Notice: Subject to any disclaimer, the term of this patent is extended or adjusted under 35 U.S.C. 154(b) by 0 days.

(21) Appl. No.: 09/306,520

(22) Filed: May 6, 1999

(30) Foreign Application Priority Data

Jun. 12, 1998 (NL) ..... 1009394

(51) Int. Cl.[7] ..... B41L 13/00

(52) U.S. Cl. ..... 101/120; 101/123; 101/124; 101/126; 101/116

(58) Field of Search ..... 101/120, 116, 101/169, 154, 269, 350.6, 363, 123, 124, 126

(56) References Cited

U.S. PATENT DOCUMENTS

| | | | | |
|---|---|---|---|---|
| 3,596,595 | * | 8/1971 | Zimmer | 101/120 |
| 4,557,194 | * | 12/1985 | Zimmer | 101/120 |
| 5,148,743 | * | 9/1992 | Zimmer | 101/123 |
| 5,405,487 | * | 4/1995 | Galchefski et al. | 156/566 |

FOREIGN PATENT DOCUMENTS

| | | |
|---|---|---|
| 225 3527A | 5/1974 | (DE) . |
| 0 36 9540B1 | 3/1994 | (EP) . |
| 0 633 135A1 | 1/1995 | (EP) . |
| 0 732 199A1 | 9/1996 | (EP) . |
| 0 769 374A1 | 4/1997 | (EP) . |

* cited by examiner

*Primary Examiner*—John S. Hilten
*Assistant Examiner*—Minh Chau
(74) *Attorney, Agent, or Firm*—Hoffmann & Baron, LLP

(57) ABSTRACT

A magnet bar for exerting an attracting force on a doctor, which is arranged above the magnet bar, of a screen-printing or coating device comprises an elongate top plate and an elongate magnet carrier which extends below and substantially parallel to the top plate and on which permanent magnets are arranged next to one another in the longitudinal direction. The distance between the magnet carrier and the top plate can be adjusted by means of a displaceable adjustment member, which is arranged below the magnet carrier, in order to adjust the magnitude of the attracting force. The magnet carrier is supported freely on the adjustment member and the weight of the magnet carrier with magnets or the sum of the weight of the magnet carrier with magnets and the force of at least one spring acting upon the magnet carrier in downward direction is greater than the maximum attracting force which can be exerted by the magnets on a doctor which is arranged above the magnet bar.

17 Claims, 4 Drawing Sheets

MAGNET BAR

FIELD OF THE INVENTION

The invention relates to a magnet bar for exerting an attracting force on a doctor, which is arranged above the magnet bar, of a screen-printing or coating device, comprising an elongate top plate and an elongate magnet carrier which extends below and substantially parallel to the top plate and on which permanent magnets are arranged next to one another in the longitudinal direction, it being possible to adjust the distance between the magnet carrier and the top plate by means of a displaceable adjustment member which is arranged below the magnet carrier, in order to adjust the magnitude of the attracting force.

BRIEF DESCRIPTION OF RELATED TECHNOLOGY

A magnet bar of this type is known from EP-A-0,769,374.

In a specific embodiment of the known magnet bar, the magnet carrier is connected, via a connecting link guide, to the adjustment member, which can be displaced parallel to the magnet carrier. The magnet carrier is provided on the underside with rolls with an axis of rotation which is transverse to the longitudinal direction of the magnet carrier, which rolls run in inclined slots in the adjustment member. As a result, it is possible, by displacing the adjustment member, to adjust the distance between the magnet carrier and the top plate. The connecting link guide is active both when reducing this distance and increasing it, in order to exert an upward or downward force, respectively, on the rolls.

A drawback of this structure is encountered when removing the magnet carrier and is caused by the fact that the slots in the adjustment member block the rolls in the upward direction. This prevents the magnet carrier from being lifted out of the magnet bar, making it difficult to remove the magnet carrier.

A further drawback is that there will always be a certain degree of play between the outer circumference of the rolls of the magnet carrier and the slot walls, so that the accuracy with which the distance between the magnet carrier and the top plate of the magnet bar can be adjusted leaves something to be desired, especially in the case where the rolls of the magnet carrier are alternately supported against one or the other slot wall.

A further drawback of the known magnet bar is encountered if the power supply for energizing the adjustment member fails, for example as a result of a power cut, while the distance between magnet carrier and top plate is short in order to attract a doctor situated above the top plate (magnetic force turned on) for a screen-printing or coating device which is in operation. If a general power cut or an emergency stop causes the printing or coating device to come to a standstill, the doctor is then held fixedly in the printing or coating paste by the magnetic force. As a result, the doctor can no longer be removed from the paste, so that it will dry into the remaining paste, resulting in damage to the printing device. Therefore, in order to remove the doctor in the event of disruption to the power supply, the magnetic force must be turned off as quickly as possible by pulling the magnet carrier away from the top plate, without any power supply being available, thus increasing the distance between magnet carrier and top plate. To this end, the known device is provided with an additional tension spring structure for displacing the connecting link guide such that the magnet carrier is pulled downwards, counter to the magnetic force.

SUMMARY OF THE INVENTION

The object of the invention is to eliminate the abovementioned drawbacks and to provide a magnetic bar in which the magnet carrier can be easily installed and removed, and for it to be possible to adjust the distance between the magnet carrier and the top plate of the magnet bar in a very accurate, stable and self-aligning manner, while also ensuring that the magnet bar is of simple design.

This object is achieved by means of a magnet bar of the type mentioned at the beginning which is characterized in that the magnet carrier is supported freely on the adjustment member and that the magnet carrier is subject to a downwardly directed force which is greater than the maximum attracting force which can be exerted by the magnets on a doctor which is arranged above the magnet bar.

Since the downwardly directed force on the magnet carrier ensures that the latter is always able to move downwards out of its highest working position, the magnet carrier is always supported directly on the adjustment member. Since the magnet carrier is always supported directly on the adjustment member, there is an unambiguous relationship between the displacement of the adjustment member and the distance between the magnet carrier and the top plate of the magnet bar, and therefore between the displacement of the adjustment member and the attracting force exerted by the magnet bar on a doctor which is situated above the top plate of the magnet bar. Using the structure according to the invention, the magnet carrier, after the top plate has been removed, can simply be lifted out of the magnet bar without further actions being required. The magnet bar has a simple structure which is inherently failsafe.

In order to increase the accuracy of the adjustment of the attracting force on a doctor further, particularly in the area in which this attracting force is strong, and where the working point of the magnet carrier normally lies and the change in the magnetic force in the event of a certain displacement of the adjustment member is relatively strong, it is preferable, in the case of a magnet bar in which the magnet carrier, by means of an end support element at at least one of its ends, is supported against a first end plate, which is substantially perpendicular to the top plate, of the magnet bar, for the first end plate to be provided, on the side of the magnet carrier, in the supporting area of the magnet carrier, with profiling in the direction of displacement of the magnet carrier. This makes it possible to achieve the effect that, in the event of a certain displacement of the adjustment member, the magnet carrier moves not only in a direction perpendicular to the top plate but also in a direction parallel to the top plate, so that a certain displacement of the adjustment member results in a less substantial change in the distance between the magnet carrier and the top plate.

BRIEF DESCRIPTION OF DRAWINGS

The invention will now be explained in more detail with reference to the description of a specific embodiment of the magnet bar according to the invention and with reference to the drawings, in which.

DETAILED DESCRIPTION OF THE INVENTION

Figure 1:
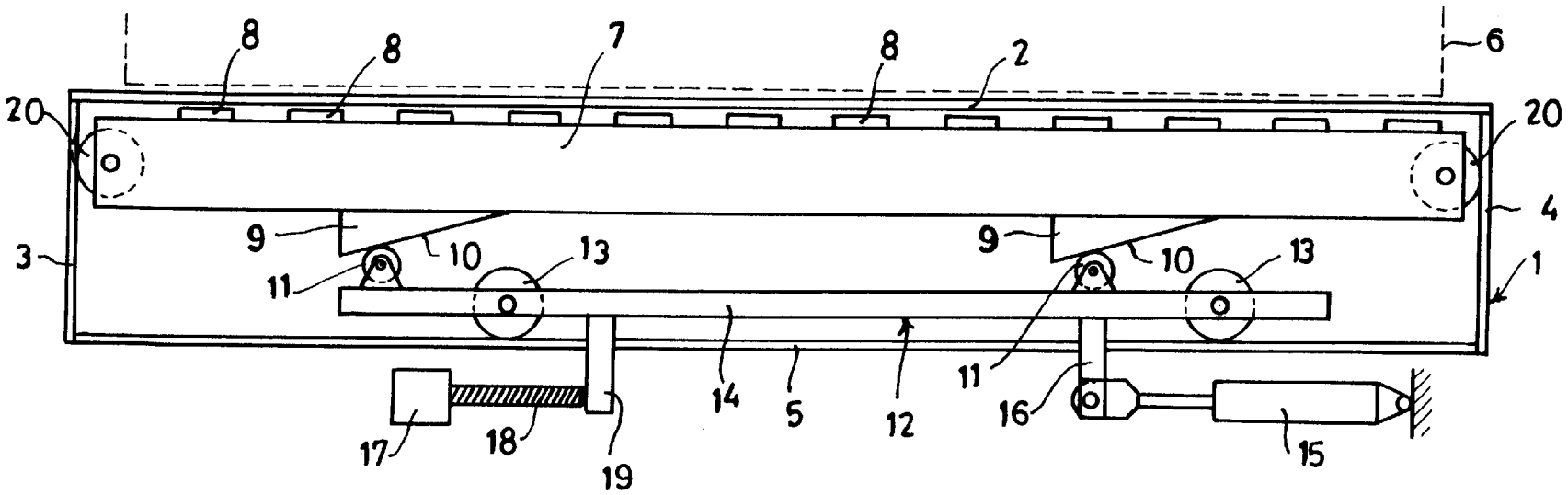
FIG. 1 shows a very diagrammatic view of a magnet bar according to the invention.

The magnet bar which is illustrated diagrammatically in the drawings and is intended to exert an attracting force on a doctor, which is positioned above the magnet bar, of a screen-printing or coating device comprises an elongate housing 1 which comprises an elongate top plate 2, two end plates 3 and 4 which are essentially perpendicular to the top plate, and a bottom part 5. In FIG. 1, dashed lines diagrammatically indicate a doctor 6 which may, for example, be a doctor roller. During operation, a supported web of material which is to be printed on or coated moves over the top side of the top plate 2, between the top plate 2 and the doctor 6. Inside the housing 1 there is an elongate magnet carrier 7 which extends substantially parallel to the top plate and on which permanent magnets 8 are arranged next to one another in the longitudinal direction. These permanent magnets exert an attracting force on a doctor 6 which is situated above the magnet bar. The permanent magnets 8 are made from one of the usual materials, preferably neodymium.

In order to be able to adjust the magnitude of the attracting force which the magnets 8 exert on the doctor 6, the distance between the magnet carrier 7 and the top plate 2 can be adjusted. To this end, the magnet carrier 7 is provided on the underside with two support elements 9 with inclined faces 10 with the same angle of inclination. The magnet carrier 7 is supported, by means of these inclined faces 10, on support elements 11 which are connected to an adjustment member 12 which can be displaced parallel to the magnet carrier 7. In the embodiment illustrated here, the support elements 11 are roll elements which roll along the inclined faces 10, and the adjustment member 12 furthermore comprises a rod-like element 14 which, via rolls 13, is supported on the bottom part 5 of the magnet bar. The horizontal displacement of the adjustment member 12 can be effected by a pneumatic or hydraulic cylinder 15 which is connected to the adjustment member 12 via a connecting piece 16. The cylinder 15 therefore indirectly brings about the displacement of the magnet carrier 7.

The position of the adjustment member 12, and consequently the position of the magnet bar 7, are determined by the position of the end of a threaded spindle 18 which is actuated by an electric motor 17 and against which a stop 19, which is connected to the adjustment member 12, comes to bear. The electric motor 17 can be used to displace the end of the threaded spindle in the horizontal direction.

It will be clear that the positioning of the adjustment member 12 and the horizontal displacement of the adjustment member 12 can also be brought about in other ways.

In order to ensure that the magnet carrier 7 always rests on the support elements 11, the weight of the magnet carrier 7, together with the magnets 8 arranged thereon, is greater than the maximum attracting force which can be exerted on the doctor 6 by the magnets 8.

The cylinder 15 is designed in such a manner that, when the pneumatic or hydraulic pressure ceases, the piston rod of the cylinder 15 and therefore the adjustment member 12 moves to the right. The magnet carrier 7 is lowered downwards under the effect of its own weight.

At its ends, the magnet carrier 7 is supported, by means of end support elements 20, in this case in the form of rolls, against the end plates 3 and 4. This ensures that the magnet bar 7 is guided accurately when displaced in the vertical direction. In view of the fact that the magnet carrier 7 is supported on the support elements 11 by means of the inclined faces 10, the support for the magnet carrier 7 in the longitudinal direction will be provided primarily by the end plate 3.

Figure 2:
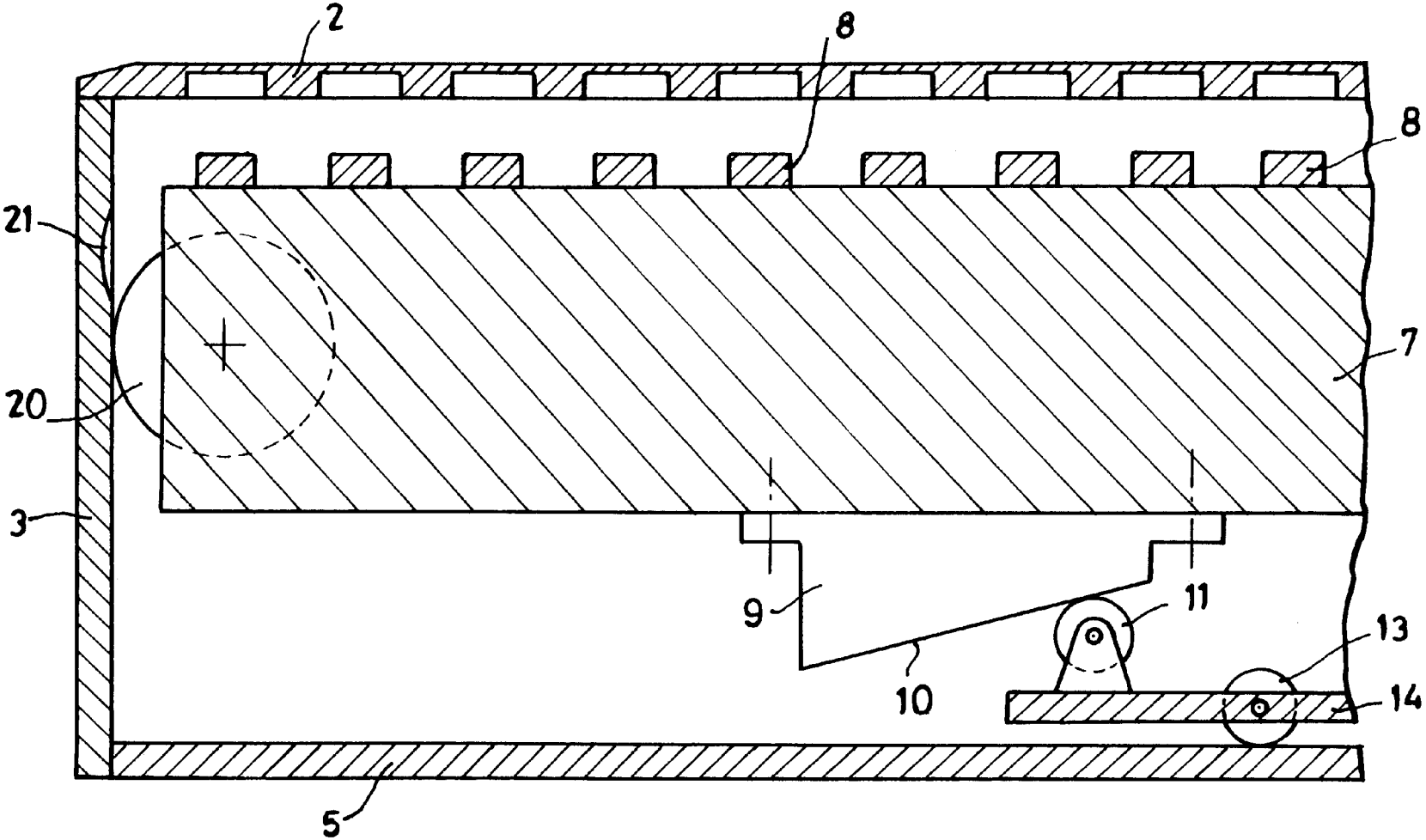
FIG. 2 shows a view, on an enlarged scale, of the end section of the magnet bar of FIG. 1, on the side of the end plate which is provided with profiling.

As can be seen in FIG. 2, the end plate 3 is provided, on the side of the magnet carrier 7, in the supporting area of the magnet carrier, with profiling in the direction of displacement of the magnet carrier 7. In FIG. 2, this profiling is in the form of a relatively shallow recess 21 in the end plate 3, which end plate 3, as has already been indicated above, provides the main support for the magnet carrier 7 in the longitudinal direction.

The purpose of the profiling 21 is to increase the accuracy of the adjustment of the attracting force exerted on a doctor by the magnet bar in the area in which the distance between the magnet carrier 7 and the top plate 2 is short and therefore the attracting force which the magnet bar exerts on the doctor 6 is strong. All this will be explained in more detail below.

Figure 3:
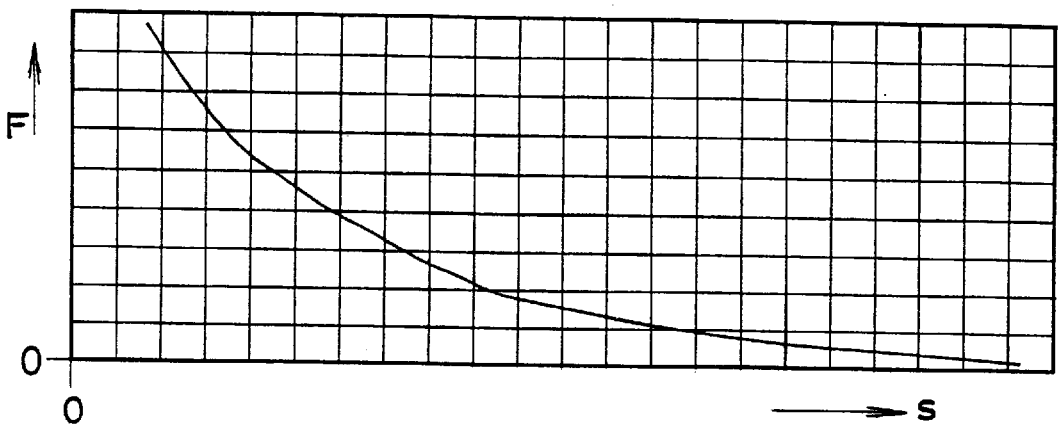
FIGS. 3 and 4 show graphs which illustrate the relationship between the position of the magnet carrier or of the adjustment member, respectively, and the attracting force exerted by the magnet bar.
Figure 4:
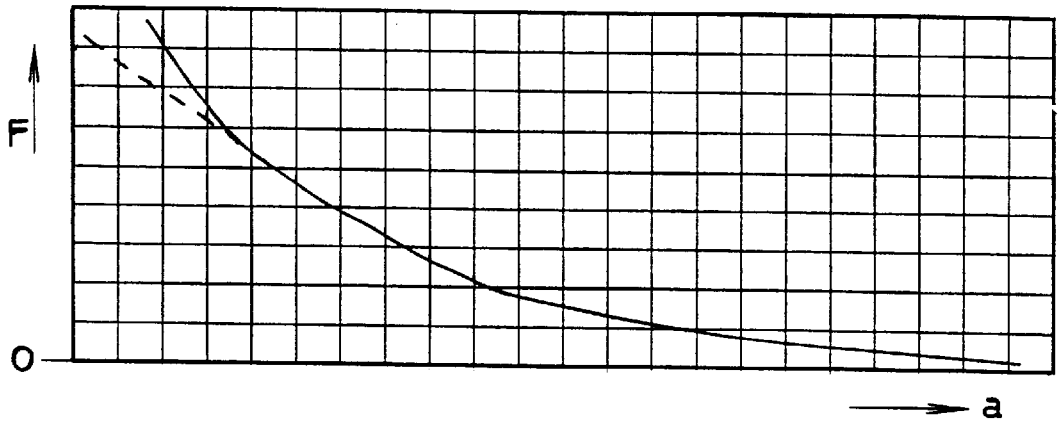

The graph shown in FIG. 3 illustrates the relationship between the distance s between the magnet carrier 7 and the top plate 2 of the magnet bar and the attracting force F exerted on a doctor 6 by the magnet bar. It can be seen in FIG. 3 that where the distance s is short, the attracting force F is strong and that in the event of a relatively slight change in the distance s the change in the attracting force F is great. The relationship between the displacement of the adjustment member 12 and the change in the distance s is determined by the form of the inclined faces 10. If the faces 10 are flat faces, the vertical displacement of the magnet carrier 7 will, in the event that the magnet carrier 7 can move only in the vertical direction, be proportional to the horizontal displacement of the adjustment member 12. This means that in the area in which the distance between the magnet carrier 7 and the top plate 2 is short, a certain displacement of the adjustment member 12 results in a substantial change in the attracting force F. This is illustrated in FIG. 4, which illustrates the relationship between the position a of the adjustment member 12 and the attracting force F. It should be noted that the scale on the horizontal axis of the graphs is different in FIGS. 3 and 4.

By providing profiling, in the form of the recess 21, in the end plate 3, a certain displacement of the adjustment member 12 will, in the area in which the distance between the magnet carrier 7 and the top plate 2 of the magnet bar is short, result in a less substantial displacement of the magnet carrier 7 in the vertical direction, since the magnet carrier 7 also moves in the horizontal direction due to the roll 20 running inside the recess 21. As a result, the change in the attracting force F is also less substantial. The relationship between the position of the adjustment member 12 and the attracting force F if the recess 21 is present is illustrated by a dashed line in FIG. 4.

Using the profiling in the end plate 3 increases the accuracy of adjustment of the attracting magnetic force which is exerted by the magnet bar on a doctor which is positioned above the magnet bar. In other words, in the area in which the distance between the magnet carrier 7 and the top plate 2 is short, the sensitivity of the attracting force F to displacements of the adjustment member 12 is reduced.

Figure 5:
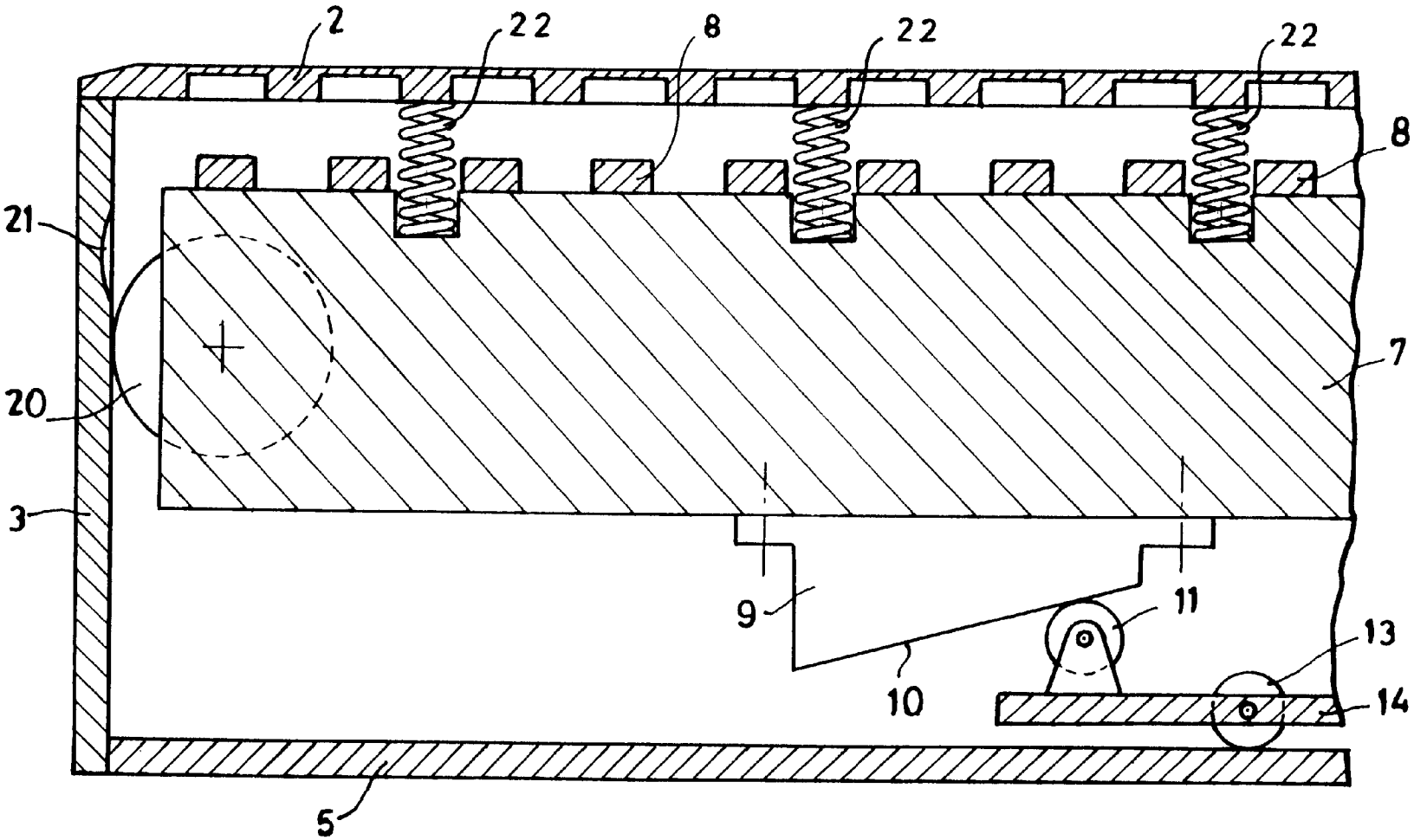
FIG. 5 shows a view, similar to FIG. 2, of a slightly modified embodiment of the magnet bar according to the invention.

FIG. 5 shows a slightly modified embodiment of the magnet bar. This embodiment comprises a number of helical compression springs 22 between the magnet carrier 7 and the top plate 2. These springs 22 exert a downwardly directed force upon the magnet carrier 7. The magnitude of the spring force is such that the sum of the spring force and the weight of the magnet carrier 7 with magnets 8 is always greater than the maximum force which can be exerted by the magnets on the doctor 6 arranged above the magnet bar. In this way it is assured that the magnet carrier 7 always rests on the support elements 11, like in the embodiment of FIGS. 1 and 2.

Due to the presence of the springs 22 the magnet carrier 7 may have a lower weight than in the embodiment of FIGS. 1 and 2. For example, the magnet carrier 7 may be made of a hollow profile (not shown).

As the springs 22 are compression springs the magnet carrier 7 can still easily be lifted out of the magnet bar after the top plate 2 has been removed.

Instead of the helical compression springs 22 shown in FIG. 5, several other types of springs may be used, such as leaf springs, pneumatic springs or hydraulic springs. The springs should preferably be compression springs. However, tension springs between the magnet carrier 7 and the bottom part 5 are also possible.

Within the scope of the invention, parts of the magnet bar may be of different design from those described above. For example, the adjustment member 12 may take a different form. Also, it is not necessary for the inclined faces 10 to be flat faces. Furthermore, the profiling in the end plate 3 may be of a different form and may be adapted to the desired relationship between the position a of the adjustment member and the attracting force F exerted on a doctor by the magnet bar.

What is claimed is:

1. A magnet bar for exerting an attracting force on a doctor, which is arranged above the magnet bar, of a screen-printing or coating device, comprising an elongate top plate and an elongate magnet carrier which extends below and substantially parallel to the top plate and on which permanent magnets are arranged next to one another in the longitudinal direction, it being possible to adjust the distance between the magnet carrier and the top plate by means of a displaceable adjustment member which is arranged below the magnet carrier, in order to adjust the magnitude of the attracting force, the magnet carrier being supported freely on the adjustment member and the magnet carrier being subject to a downwardly directed force provided by the weight of the magnet carrier with magnets which is always greater than the maximum attracting force which can be exerted by the magnets on a doctor which is arranged above the magnet bar.

2. The magnet bar of claim 1, wherein the magnet carrier is supported on the adjustment member via at least two support structures which each comprise a first support element which is connected to the adjustment member and a second support element which is connected to the magnet carrier and is supported on the first support element, at least one of the first and second support elements of each support structure having an inclined face, the inclined faces of the support structures having the same angle of inclination and the adjustment member being displaceable parallel to the magnet bar.

3. The magnet bar of claim 2, wherein one of the first and second support elements of each support structure is a roll element which, when the adjustment member is displaced, rolls along the inclined face of the other support element of the support structure in question.

4. The magnet bar of claim 2, wherein at least the second support element of each support structure which is connected to the magnet carrier has an inclined face.

5. The magnet bar of claim 1, wherein the magnet carrier, by means of an end support element located at at least one of its ends, is supported against a first end plate, which is substantially perpendicular to the top plate, of the magnet bar, the first end plate being provided, on the side of the magnet carrier, in the supporting area of the magnet carrier, with profiling in the direction of displacement of the magnet carrier.

6. The magnet bar of claim 5, wherein the profiling is formed by a relatively shallow recess in the first end plate.

7. The magnet bar of claim 1, wherein the adjustment member is connected to a drive member for displacing the adjustment member, and a separate positioning member, which is not connected to the adjustment member, is present for the purpose of positioning the adjustment member.

8. The magnet bar of claim 1, wherein the magnets are made from neodymium.

9. A magnet bar for exerting an attracting force on a doctor, which is arranged above the magnet bar, of a screen-printing or coating device, comprising an elongate top plate and an elongate magnet carrier which extends below and substantially parallel to the top plate and on which permanent magnets are arranged next to one another in the longitudinal direction, it being possible to adjust the distance between the magnet carrier and the top plate by means of a displaceable adjustment member which is arranged below the magnet carrier, in order to adjust the magnitude of the attracting force, the magnet carrier being supported freely on the adjustment member and the magnet carrier being subject to a downwardly directed force provided by the weight of the magnet carrier with magnets and at least one spring acting upon the magnet carrier in a downward direction which is always greater than the maximum attracting force which can be exerted by the magnets on a doctor which is arranged above the magnet bar.

10. The magnet bar of claim 9, wherein the at least one spring is a compression spring provided between the magnet carrier and the top plate of the magnet bar.

11. The magnet bar of claim 9, wherein the magnet carrier is supported on the adjustment member via at least two support structures which each comprise a first support element which is connected to the adjustment member and a second support element which is connected to the magnet carrier and is supported on the first support element, at least one of the first and second support elements of each support structure having an inclined face, the inclined faces of the support structures having the same angle of inclination and the adjustment member being displaceable parallel to the magnet bar.

12. The magnet bar of claim 11, wherein one of the first and second support elements of each support structure is a roll element which, when the adjustment member is displaced, rolls along the inclined face of the other support element of the other support structure in question.

13. The magnet bar of claim 11, wherein at least the second support element of each support structure which is connected to the magnet carrier has an inclined face.

14. The magnet bar of claim 9, wherein the magnet carrier, by means of an end support element located at at least one of its ends, is supported against a first end plate, which is substantially perpendicular to the top plate, of the magnet bar, the first end plate being provided, on the side of the magnet carrier, in the supporting area of the magnet carrier, which profiling in the direction of displacement of the magnet carrier.

15. The magnet bar of claim 14, wherein the profiling is formed by a relatively shallow recess in the first end plate.

16. The magnet bar of claim 3, wherein the adjustment member is connected to a drive member for displacing the adjustment member, and a separate positioning member, which is not connected to the adjustment member, is present for the purpose of positioning the adjustment member.

17. The magnet bar of claim 3, wherein the magnets are made from neodymium.

* * * * *